US009534481B2

(12) United States Patent
Ayan et al.

(10) Patent No.: US 9,534,481 B2
(45) Date of Patent: Jan. 3, 2017

(54) FORMATION TREATMENT EVALUATION

(71) Applicant: Schlumberger Technology Corporation, Sugar Land, TX (US)

(72) Inventors: Cosan Ayan, Istanbul (TR); Fikri John Kuchuk, Meudon (FR); Terizhandur S. Ramakrishnan, Boxborough, MA (US); Thomas J. Neville, Broadbeach (AU); Raghu Ramamoorthy, Pune (IN); Andrew J. Carnegie, Perth (AU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/733,856

(22) Filed: Jun. 8, 2015

(65) Prior Publication Data

US 2015/0267521 A1 Sep. 24, 2015

Related U.S. Application Data

(63) Continuation of application No. 12/937,403, filed as application No. PCT/US2009/040627 on Apr. 15,
(Continued)

(51) Int. Cl.
*E21B 43/16* (2006.01)
*E21B 33/124* (2006.01)
(Continued)

(52) U.S. Cl.
CPC ..... *E21B 43/16* (2013.01); *E21B 33/124* (2013.01); *E21B 43/24* (2013.01);
(Continued)

(58) Field of Classification Search
CPC ..... E21B 33/124; E21B 43/16; E21B 43/24; E21B 43/2401; E21B 43/25; E21B 43/26; E21B 49/087; E21B 49/10
See application file for complete search history.

(56) References Cited

U.S. PATENT DOCUMENTS 4,168,746 A 9/1979 Sheely
4,339,948 A * 7/1982 Hallmark ..... E21B 49/10 166/264
(Continued)

FOREIGN PATENT DOCUMENTS

RU 2242772 C2 12/2004
RU 2305877 C2 9/2007
(Continued)

OTHER PUBLICATIONS

European Examination Report issued in EP09731746.5 on Apr. 12, 2012, 2 pages.
(Continued)

*Primary Examiner* — James G Sayre
(74) *Attorney, Agent, or Firm* — Kenneth L. Kincaid

(57) ABSTRACT

Measuring a parameter characteristic of a formation in an oil well with a device configured to generate a sensing field within a volume of the formation and cause a flow through the volume in the presence of the sensing field. The device also comprises sensors responsive to changes in the volume, which indicate existent amounts of fluid, such as hydrocarbon and water saturations and irreducible hydrocarbon and water saturations. Measurements may be made before the flow affects the measuring volume and after onset of the flow through the measuring volume.

18 Claims, 8 Drawing Sheets

Related U.S. Application Data

2009, now Pat. No. 9,051,822, and a continuation-in-part of application No. 12/103,027, filed on Apr. 15, 2008, now Pat. No. 8,297,354.

(60) Provisional application No. 61/080,430, filed on Jul. 14, 2008.

(51) Int. Cl.

| | |
|---|---|
| ***E21B 43/25*** | (2006.01) |
| ***E21B 43/24*** | (2006.01) |
| ***E21B 49/08*** | (2006.01) |
| ***E21B 43/26*** | (2006.01) |
| ***E21B 49/10*** | (2006.01) |

(52) U.S. Cl.

CPC ..... *E21B 43/2401* (2013.01); *E21B 43/25* (2013.01); *E21B 43/26* (2013.01); *E21B 49/087* (2013.01); *E21B 49/10* (2013.01)

(56) References Cited

U.S. PATENT DOCUMENTS

| | | | | |
|---|---|---|---|---|
| 4,427,944 | A | 1/1984 | Chandler | |
| 4,529,939 | A | 7/1985 | Kuckes | |
| 5,148,705 | A | 9/1992 | Desbrandes | |
| 5,269,180 | A | 12/1993 | Dave et al. | |
| 5,335,542 | A | 8/1994 | Ramakrishnan et al. | |
| 5,497,321 | A | 3/1996 | Ramakrishnan et al. | |
| 5,741,962 | A * | 4/1998 | Birchak | E21B 49/10 73/152.16 |
| 5,826,656 | A | 10/1998 | McGuire et al. | |
| 6,301,959 | B1 * | 10/2001 | Hrametz | E21B 33/1243 166/250.17 |
| 6,348,792 | B1 | 2/2002 | Beard et al. | |
| 6,518,758 | B1 | 2/2003 | Speier et al. | |
| 6,528,995 | B1 | 3/2003 | Speier et al. | |
| 6,531,869 | B1 | 3/2003 | Speier et al. | |
| 6,538,438 | B1 | 3/2003 | Speier et al. | |
| 6,642,715 | B2 | 11/2003 | Speier et al. | |
| 6,690,170 | B2 | 2/2004 | Homan et al. | |
| 6,710,596 | B2 | 3/2004 | Speier et al. | |
| 6,856,132 | B2 * | 2/2005 | Appel | G01V 3/32 324/303 |
| 6,886,632 | B2 | 5/2005 | Raghuraman et al. | |
| 6,978,672 | B1 | 12/2005 | Chen et al. | |
| 7,032,661 | B2 | 4/2006 | Georgi et al. | |
| 7,180,288 | B2 | 2/2007 | Scheven | |
| 7,191,831 | B2 | 3/2007 | Reid et al. | |
| 7,221,158 | B1 | 5/2007 | Ramakrishnan | |
| 7,233,150 | B2 | 6/2007 | Chen et al. | |
| 7,243,718 | B2 | 7/2007 | Chen et al. | |
| 7,301,345 | B2 | 11/2007 | Chen et al. | |
| 7,532,007 | B2 | 5/2009 | Song et al. | |
| 7,841,402 | B2 | 11/2010 | Georgi et al. | |
| 8,297,354 | B2 | 10/2012 | Ayan et al. | |
| 9,051,822 | B2 | 6/2015 | Ayan et al. | |
| 2003/0192689 | A1 | 10/2003 | Moake et al. | |
| 2003/0229448 | A1 | 12/2003 | Storm, Jr. et al. | |
| 2004/0055745 | A1 | 3/2004 | Georgi et al. | |
| 2005/0279497 | A1 | 12/2005 | Chen et al. | |
| 2006/0000606 | A1 | 1/2006 | Fields et al. | |
| 2006/0089804 | A1 | 4/2006 | Chen et al. | |
| 2007/0039731 | A1 | 2/2007 | Fox et al. | |
| 2007/0057674 | A1 | 3/2007 | Chen et al. | |
| 2007/0170924 | A1 | 7/2007 | Chen et al. | |
| 2007/0193351 | A1 * | 8/2007 | DiFoggio | E21B 47/10 73/152.02 |
| 2007/0289736 | A1 * | 12/2007 | Kearl | E21B 43/2401 166/248 |
| 2008/0066536 | A1 | 3/2008 | Goodwin et al. | |
| 2008/0066904 | A1 | 3/2008 | Van Hal et al. | |

FOREIGN PATENT DOCUMENTS

| | | | |
|---|---|---|---|
| WO | 2007069201 | A2 | 6/2007 |
| WO | 2008152345 | A2 | 12/2008 |
| WO | 2009129289 | A2 | 10/2009 |

OTHER PUBLICATIONS

Ramakrishnan, T.S. et al., "Water-Cut and Factional-Flow Logs from Array-Induction Measurements," SPE 54673 Society of Petroleum Engineers Reservoir Evaluation & Engineering, Feb. 1999, vol. 2, No. 1, pp. 85-94.

Freedman, R. et al. "A New NMR Method of Fluid Characterization in Reservoir Rocks: Experimental Confirmation and Simulation Results," SPE 63214, Transactions of the 2000 SPE Annual Technical Conference and Exhibition, Dallas, TX, USA, Oct. 1-4, 2000, pp. 1-15.

Cassou, G. et al. Movable Oil Saturation Evaluation in an Ultra-Mature Carbonate Environment, Society of Petrophysicists and Well Log Analysts 1st Annual Middle East Regional Symposium, Apr. 15-19, 2007, pp. 1-16.

* cited by examiner

FORMATION TREATMENT EVALUATION

CROSS REFERENCE TO RELATED APPLICATIONS

This application is a continuation of co-pending U.S. patent application Ser. No. 12/937,403, filed Apr. 15, 2009, which is a continuation-in-part application of U.S. patent application Ser. No. 12/103,027, filed Apr. 15, 2008, now U.S. Pat. No. 8,297,354, the contents of both being incorporated herein by reference for all purposes.

This application also claims priority to U.S. Provisional Patent Application 61/080,430, filed Jul. 14, 2008.

BACKGROUND

In the course of assessing and producing hydrocarbon bearing formation and reservoirs, it is important to acquire knowledge of formation and formation fluid properties which influence the productivity and yield from the drilled formation. Typically, such knowledge is acquired by "logging" operations which involve the measurement of a formation parameter or formation fluid parameter as function of location within the wellbore. Formation logging has evolved to include many different types of measurements, including those based on acoustic, electro-magnetic or resistivity, and nuclear interactions, such as nuclear magnetic resonance (NMR) or neutron capture.

NMR measurements are commonly used in the wellbore to probe the NMR decay behavior of the stationary fluid in the reservoir rock. During these measurements, magnetic fields are established in the formation using suitably arranged magnets. The magnetic fields induce nuclear magnetization, which is flipped or otherwise manipulated with on-resonance radio frequency (RF) pulses. NMR echoes are observed, and their dependence on pulse parameters and time is used to extract information about the formation and the fluids in it.

In particular, NMR has been used in the oilfield industry to obtain information and parameters representative of bound fluids, free fluids, permeability, oil viscosity, gas-to-oil ratio, oil saturation and water saturations. These parameters can be derived from measurements of spin-spin relaxation time, often referred to as T2, spin-lattice relaxation time (T1), and self-diffusion coefficient (D) of the molecules containing hydrogen contained in formation fluids.

On the other hand, fluids are routinely sampled in the well bore with the help of formation testers or formation fluid sampling devices, such as Schlumberger's MDT, a modular dynamic fluid testing tool. Such a tool may include at least one fluid sample bottle, a pump to extract the fluid from the formation or inject fluid into the formation, and a contact pad with a conduit to engage the wall of the borehole.

With the pumping, a flow in the formation is induced by extracting fluid from the formation through the conduit. The fluid flowing through the tool is analyzed in situ using electrical, optical or NMR based methods. Typically, when the fluid is assumed to be 'pure' reservoir fluid, i.e., when having acceptable levels of mud or other contaminants, a sample of the fluid is placed into the sample bottle for later analysis at a surface laboratory. The module is then moved to the next region of interest or station.

Fluid flow into the borehole is also routinely produced using dual packer arrangements which isolate sections of the borehole during fluid and pressure testing. By reversing the flow direction, dual packer arrangements offer the possibility of conducting fracturing operations which are designed to fracture the formation around the isolated section of the borehole.

It is further well established to mount logging tools on either dedicated conveyance means such as wireline cables or coiled tubing (CT) or, alternatively, on a drill string which carries a drill bit at its lower end. The latter case is known in the industry as measurement-while-drilling (MWD) or logging-while-drilling (LWD). In MWD and LWD operations, the parameter of interest is measured by instruments typically mounted close behind the bit or the bottom-hole assembly (BHA).

Applications and measurements designed to exploit the flow generated by tools such as the above formation testing tools in combination with NMR type measurements are described in a number of documents. One example is U.S. Pat. No. 7,180,288. Other NMR-based methods for monitoring flow and formation parameters can be found in U.S. Pat. Nos. 6,642,715 and 6,856,132. A tool which combines a fluid injection/withdrawal tool with a resistivity imaging tool is described in U.S. Pat. No. 5,335,542. Borehole tools and methods for measuring permeabilities using sequential injection of water and oil is described in U.S. Pat. Nos. 5,269,180 and 7,221,158. Also, in U.S. Pat. No. 5,497,321 details a method to compute fractional flow curves using resistivity measurements at multiple radial depths of investigation.

In a paper prepared for presentation at the SPWLA 1st Annual Middle East Regional Symposium, Apr. 15-19, 2007, authors Cassou, Poirier-Coutansais, and Ramamoorthy demonstrate that the combination of advanced-NMR fluid typing techniques with a dual-packer fluid pumping module can greatly improve the estimation of the saturation parameter in carbonate rocks. The ability to perform 3D-NMR stations immediately before and after pump-outs yields both the water and oil saturations (Sw,Sxo) independently of lithology, resistivity, and salinity, in a complex carbonate environment.

BRIEF DESCRIPTION OF THE FIGURES

The present disclosure is best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION

Figure 1A:
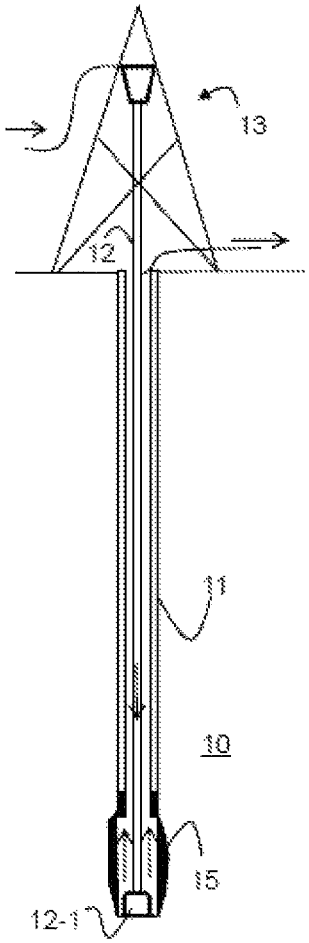
Fig. 1A (Prior Art)
FIGS. 1A and 1B are schematic views of prior art drilling apparatus.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure introduces a tool for measuring a parameter characteristic of a rock formation. The tool may be positionable in a section of a well penetrating the rock formation, and may comprise: a device configured to generate a sensing field in a measuring volume within the rock formation; and a device for causing a flow through the measuring volume, possibly in the presence of the sensing field. The tool may further comprise one or more sensors responsive to changes in the sensing field, wherein sensor responses are indicative of the amounts of fluid in the measuring volume in different states of the flow, possibly including a state before the generated flow affects the measuring volume and a state after onset of the flow through the measuring volume.

For the purposes of the present disclosure, an "amount of fluid" may include parts or percentages of formation fluid which consist of hydrocarbon and/or parts or percentages which consist of water. In the industry, and herein, two of the most utilized of such parameters may be referred to as hydrocarbon saturation (Shc) or oil saturation (So) and water saturation (Sw), respectively.

According to one or more aspects of present disclosure, a fluid may be withdrawn or injected into the formation to sweep away the hydrocarbon. Thereafter, a measure of the residual oil saturation (ROS) may be obtained with the subsequent measurements. In an alternative variant, a hydrocarbon-based fluid such as formation crude oil may be injected into the formation to estimate the amount of the residual water saturation (Swr). Both parameters, ROS and Swr may be end-points in the determination of relative permeability relations as a function of saturation, and may thus be ultimately used to determine a measure of the recovery factors for the reservoir.

In a further variant, the saturation of a phase in the formation and flow rates or cuts of fluid phases may be measured. Knowledge of the flow volumes or fractional flows in dependence of the saturation may be used to derive directly the relative permeability of a phase in the formation.

The present disclosure further contemplates the use of a sensing field based on logging measurements which can sense the change of a parameter within the formation, including sonic, acoustic, magnetic and electro-magnetic sensing fields. Hence, the sensors may be responsive to one of these types of fields and register electro-magnetic signals, resistivity signals, dielectric signals, NMR signals and neutrons capture. The sensors may register such signals at multiple depths as measured in radial direction from the well. The sensing field may comprise a magnetic field. Distributions of the spin-lattice relaxation or T1 distributions or distributions of spin-spin relaxation (T2) may be derived from the sensor response. For in situ measurements of the time-evolution of a parameter, faster methods based on induction or resistivity arrays may be employed, perhaps making use of tools such as the resistivity imaging tool described in U.S. Pat. No. 5,335,542.

Regarding the NMR based methods, magnetic resonance fluid (MRF) characterization may be applied to the sensor response. MRF characterization may comprise a multi-sequence NMR acquisition where polarization time and echo spacing are varied, resulting in a sensitivity to diffusion and T1 and T2 distributions. MRF measurements may be used to measure Sw and So in carbonates independent of lithology, resistivity, and salinity.

The capability to perform and compare two or more MRF measurements in a time-lapse manner before and after an induced flow may reduce some of the uncertainties caused by the drilling process and formation invasion. Invasion of drilling fluid filtrate changes the fluid composition near the wellbore. Fluid flow from the formation into the tool may replace filtrate with formation fluid, thus placing the measuring volume in the formation into a state much closer to its original state prior to drilling. Controlled injection of a known fluid may be used to create a zone which is more completely flushed than by merely the uncontrolled and unmonitored invasion of mud filtrate.

While it is possible to generate flow by any tool which is capable of causing a pressure gradient across the surface of the well, embodiments within the scope of the present disclosure may employ tools which are coupled with means to determine flow related parameters. Such tools may therefore be variants of the known formation sampling tools modified such that the sensing tool can project its sensing field into the volume of the formation subject to the flow caused by the sampling tool.

The flow may be enabled by engaging the wall of the well with a probe of the sampling tool and using a pumping mechanism to withdraw fluid from the formation. However, the flow may also or alternatively be caused by injecting a fluid into the formation, wherein the parameter may be measured while having a flow into and out of the formation.

The monitored amounts of fluids in the formation may be analyzed for compositional changes in the hydrocarbon phase as caused by the flow. Stationary measurements may be repeated under different flow conditions, e.g., before, during, and after the induced flow.

The amount or total volume of hydrocarbon in a measuring volume within the formation may be decomposed in accordance with the values of a parameter which may be derived from the measurement. These fractioned or decomposed parts of the hydrocarbon may behave differently under different flow conditions. Such measurements may therefore lead to parameters related to the composition of the formation fluid. This parameter may be the T1 or T2 distribution or a parameter derivable from these distributions, such as viscosity. Observing the reservoir fluid decomposed according to such a parameter may allow better estimates of recoverable reserves and/or the effectiveness of enhanced oil recovery (EOR) treatments.

Methods within the scope of the present disclosure may be used to determine the effectiveness of EOR in various manners. EOR methods may include the injection of specialized chemical compounds such as surfactants or water blocking gels into the formation. EOR methods may also include thermal-based reservoir treatments such as steam or gas injections. By monitoring the reaction of the fluid in the measuring volume within the formation, it may be possible to estimate the efficacy of such an EOR treatment on a larger reservoir scale. The effectiveness of chemicals, such as surfactants, when injected into the formation may be monitored in situ and evaluated accordingly to derive further important parameters such as effective hydrocarbon recovery factors with and without the treatment.

In FIG., 1A, a well 11 is shown in the process of being drilled through a formation 10. A drill string 12 is suspended from the surface by means of a drilling rig 13. A drill bit 12-1 is attached to the bottom of the drill string 12.

While drilling, a drilling fluid is circulated through the drill string 12 and the drill bit 12-1 to return to the surface via the annulus between the wall of the well 11 and the drill string 12. During this process, part of the drilling fluid invades a shallow zone 15 around the borehole 11, thus contaminating the formation fluid.

Figure 1B:
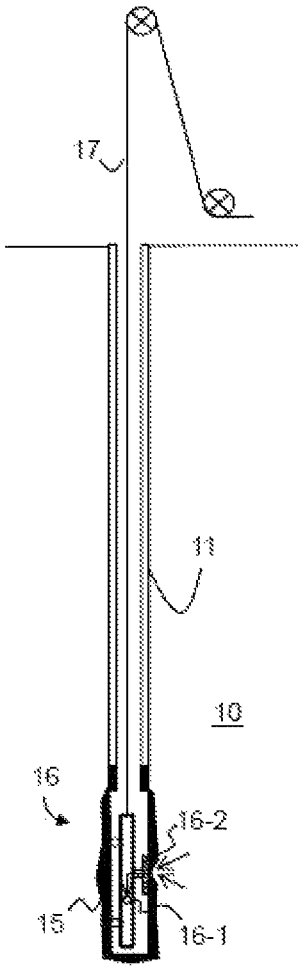
Fig. 1B (Prior Art)

After completing the drilling through a hydrocarbon bearing formation, a wireline tool 16 as shown in FIG. 1B, is lowered into the well 11 using a wireline cable 17. In the example as illustrated, the wireline tool includes a formation testing device 16-1 which may be used to generate a flow in the formation, and an NMR-based tool 16-2 comprising a combination of permanent magnets and antennas (not shown) configured to generate a magnetic field within the volume of the formation affected by the flow. Examples of such tools include those in U.S. Pat. Nos. 7,180,288; 6,642,715; and 6,856,132.

Figure 2A:
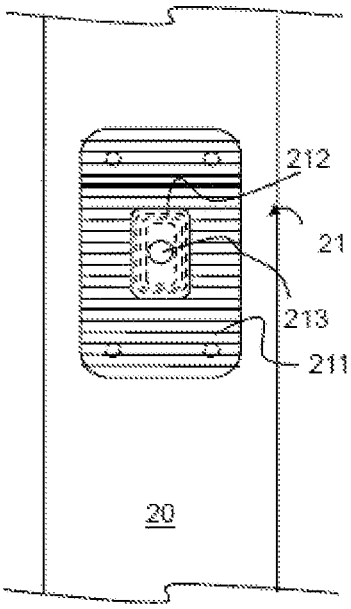
FIGS. 2A and 2B are schematic frontal and cross-sectional views of apparatus according to one or more aspects of the present disclosure.
Figure 2B:
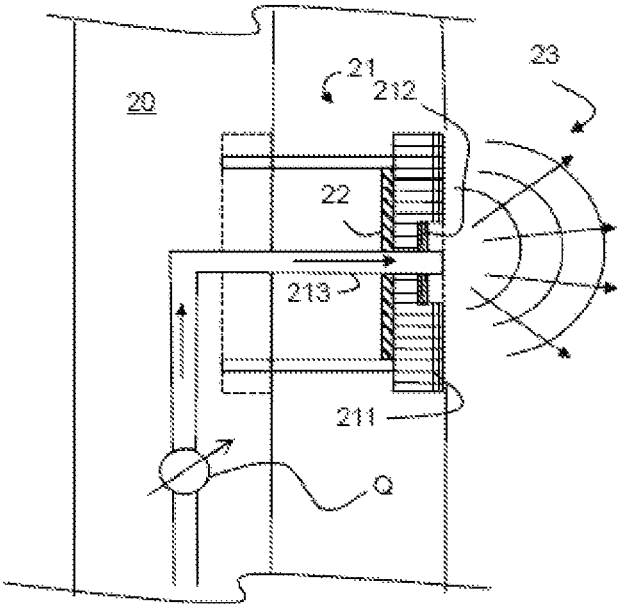

However, a variant of such a tool is illustrated in FIGS. 2A and 2B. The body 20 of the downhole logging tool comprises a sampling probe taking the shape of a pad 21. The pad 21 comprises an outer zone 211 of magnetic material behind a sealing layer of elastic material. The magnetic material may be permanently magnetic and may generate a magnetic field in those parts of the formation which face the probe. An inner zone of the pad 21 comprises an antenna area 212 and a flowline 213. A feed circuit 22 configured to power and control the antenna may be located behind the pad 21. The flowline 213 may include a conventional or future-developed flowmeter Q.

The antenna may be designed to deliver NMR pulses 23 into the formation. The tool as illustrated is in a state of injecting fluid from the tool body 20 into the formation. In other states, fluid may flow in reverse direction, i.e., from the formation into the flowline 213. The antenna 212 is in a recessed area of the pad 21. The recessed area may effectively act like a funnel, thus drawing in or injecting flow from a bigger effective area and in turn enlarging the measuring volume where flow and magnetic field overlap. The recessed area may also serve to protect the antenna from impact and sealing forces acting when the pad 21 makes contact with the formation.

For an electro-magnetic or resistivity-based measurement, the combination of an NMR tool and formation testing tool as shown above can be replaced by a combination of resistivity array tool and formation testing tool. Such a tool is described for example in U.S. Pat. No. 5,335,542. Other sensing fields may require a corresponding change of the type of source and receivers in the tool body. Other known acoustic, sonic or electromagnetic logging tool designs may be adapted according to one or more aspects of the present disclosure and, thus, such embodiments are also within the scope of the present disclosure.

Additional measuring devices (not shown) may be integrated into the flowline 213 of the sampling tool, such as optical, NMR, or resistivity based sensors, among others, and may be configured to measure composition-related parameters of the sampled or ejected flow inside the tool. The tool may also comprise one or more flow meters Q configured to determine the total flow (e.g., water flow Qw+hydrocarbon flow Qo). The flowline 213 may also be connected to a flow generator or pump (not shown) located within the body of the logging tool. Such flow generator may be configured to move fluids from the formation into the body of the tool or from a storage tank (not shown) within the body of the tool into the formation.

Figure 3:
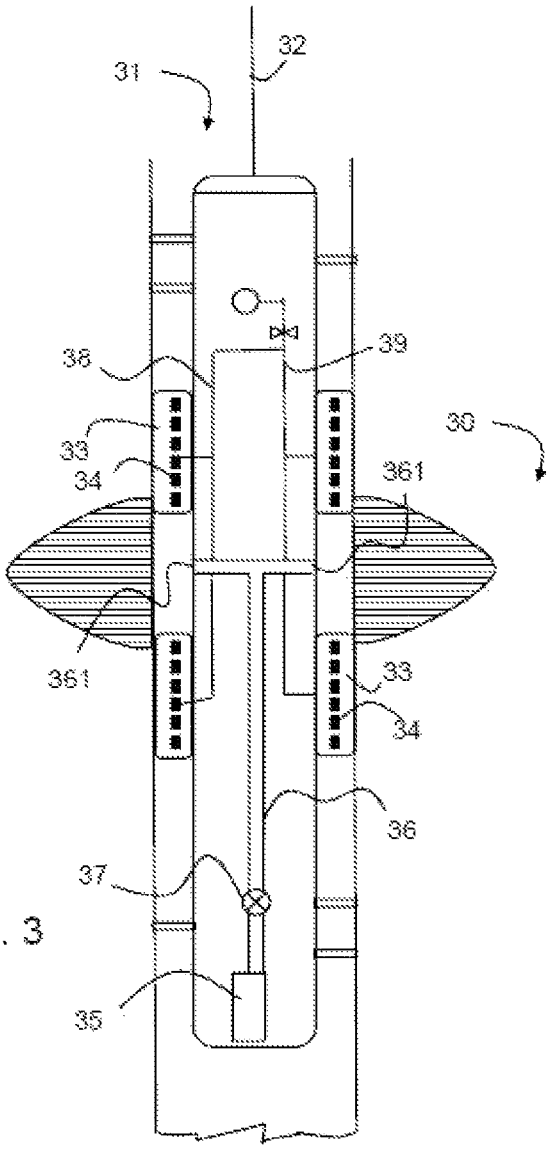
FIG. 3 is a schematic cross-sectional view of apparatus according to one or more aspects of the present disclosure.

A wireline 32 suspended dual packer tool 31 suitable for performing measurements in accordance with one or more aspects of the present disclosure is shown in FIG. 3. The tool 31 may comprise a pair of packers 33 comprising integrated arrays of sensors 34. The sensors 34 may be configured as an array of electrodes, antennas, gamma-ray receivers, or emitters, among others, depending on the measurement to be performed. The packers 33 are configured to isolate a zone 30 of the formation.

The tool 31 further comprises a fluid reservoir chamber 35 connected to fluid ports 361 via a flow line 36. Fluid flow through the flow line 36 may be driven by a pumping module 37 which may be configured to cause or support flow from the formation into the reservoir chamber 35 or from the chamber 35 into the formation. Depending on the type of experiment to be performed, the chamber 35 may contain sample fluids such as water or oil, or solutions of active chemicals to modify the formation, the formation fluids, or the response of the formation or formation fluid to the sensing field. The tool 31 may also comprise an electrical connection 38 to the packer 33 and a hydraulic connection 39 to the sensors 34.

The measurement as proposed in the present disclosure may result in a response signal from the fluid located inside the measuring volume and hence inside the formation. Previous efforts of combining NMR and a sampling tool have mostly focused on measuring the properties of the sampled fluid or its velocity after it leaves the formation and moves through the flow line of the tool. In the present disclosure, the sampling tool is employed as a means to generate a flow in the formation. This flow changes the values of parameters associated with the formation while leaving others unchanged. It has been observed that by recording such changes, parameters employed to characterize the formation may be determined with greater accuracy, possibly revealing previously unknown aspects.

Figure 4A:
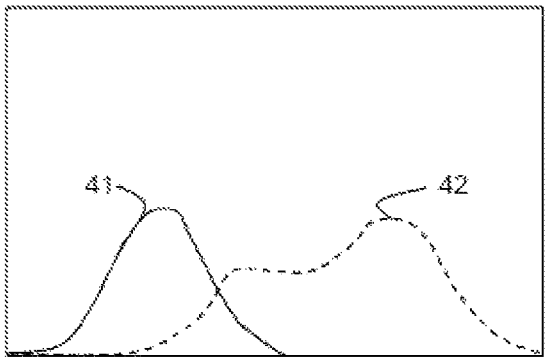
FIG. 4A is a graph of an NMR tool measurement.

The oil and water saturations of the formation fluids may be determined as a function of the flow rate. The saturations may be determined, for example, by evaluating measured T1 or T2 distribution curves. To illustrate this principle, a simplified example of such curves is shown in FIG. 4A. The water signal is shown as a solid line 41 and the oil signal as a dashed line 42. Saturations may be determined from such a measurement by calculating the ratio of the relative areas under the curves to the total area.

The response of the formation to many measurements, including the NMR type measurement above, may be modified through injection of a suitable chemical. Using, for example, $MnCl_2$ or NiCl as part of an injected fluid may reduce the water response signal or shift it to very short T2 values. This effect results in a clear separation between the water and oil signals in the T2 domain, and the residual oil saturation estimation becomes a simple volumetric determination based on the measured T2 distribution.

While the example as illustrated is simplified for the sake of simplicity, other measurements within the scope of the present disclosure may be based on more advanced methods of evaluating NMR data, such as MRF methods or other known methods of acquiring and interpreting three-dimensional (3D) NMR data.

With the saturation values determined using the NMR based methods as described in the above example or measurements based on other sensing fields, the flowmeter Q may be used to measure the water cut or flow Qw and/or the hydrocarbon cut or flow Qo of the sampling tool. The term "cut" is used herein to indicate the amount of a single phase in what is typically a multiphase flow produced from the borehole.

If required, the time lag between the flow measurements and the saturation measurements may be compensated for by calculating the average flow velocity between the location of the saturation measurement and the flowmeter location inside the tool body. Alternatively, performing such compensation may comprise using correlations between the NMR measurements and the flowmeter and selecting the time lag which maximizes such correlations. The compensation ensures that the measurement as performed by the flow meter reflects the composition of the flow as it passes through the measuring volume of the NMR tool for evaluation.

The measured saturations and flow rates may be matched to fit a relation or model which includes the relative permeabilities kro or krw. Theoretically, the measured points may lie on curves such as shown in FIG. 5A.

Figure 5A:
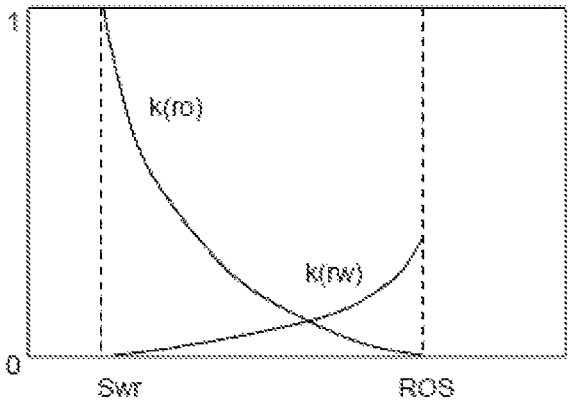
FIGS. 4B, 5A and 5B are graphs illustrating one or more aspects of the present disclosure.

FIG. 5A graphically depicts the relative permeability kro of hydrocarbon as a function of saturation and the relative permeability krw of water as a function of saturation. The endpoints of both curves are defined by the residual water saturation Swr and the residual hydrocarbon saturation ROS. Based on the theory of this relation, it may not be required to determine more than two points to derive a useful estimate of a relative permeability curve. These two points may be the permeability at the residual water saturation Swr and the residual hydrocarbon saturation ROS. However, the accuracy of such an estimate or model may be increased by determining more measurements points on the curves.

Figure 5B:
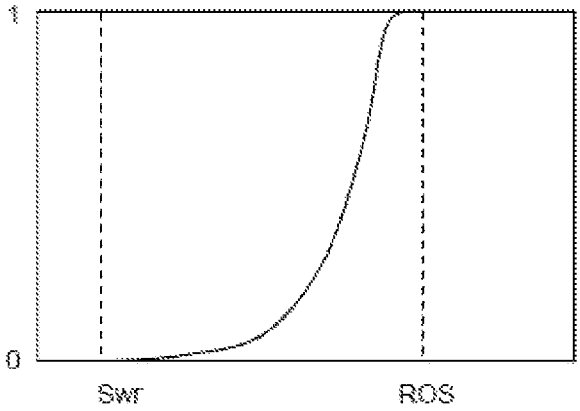

Once the relative permeabilities krw(Sw) and kro(Sw) are established as functions of the saturation, it is possible to derive the fractional flow using for example equation [1] below with μw being the water viscovity and μo being the oil viscosity:

$$fw(Sw)=(krw(Sw)/\mu w)/(krw(Sw)/\mu w+kro(Sw)/\mu o) \quad [1]$$

resulting in curves for the fractional flow rates as a function of the saturation, as shown for the flow rate fw(Sw) of the water phase in FIG. 5B. Once established, this function may be used to determine important parameters. For example, a measure of the recoverable oil in the formation may be derived by measuring the actual saturations and their respective distance to the endpoints of the saturation curves, indicating the residual oil or water saturations.

The T1 or T2 distributions as shown in FIG. 4A may be recorded as a function of time and, therefore, as a function of the flow which passed through the monitored formation volume. The benefit of such a measurement may be demonstrated by comparing the schematic FIGS. 4A and 4B. The latter figure shows the same measuring volume but after an injection of water.

The measured distribution gives an indication of the residual oil saturation ROS by evaluating the area of the "oil peak", which is reduced after the injection of water from the tool as described above. However, apart from the determination of saturations, the distribution may be further evaluated to make determinations as to the composition of the hydrocarbon.

The absolute value of T1 or T2 may be linked to fluid related parameters such as viscosity. Hence, each value of T1 (or T2) may be taken in this example as a value representative of viscosity.

Figure 4B:
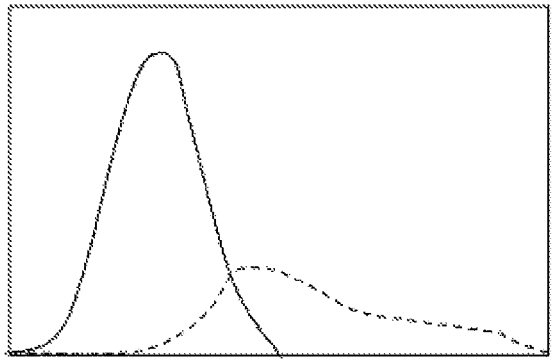

In FIGS. 4A and 4B, which together illustrate the case of a composition change in the formation fluid due to a water injection, the oil peak is not only reduced in amplitude, but the amplitude reduction in FIG. 4B relative to the original amplitudes of FIG. 4A differs for different values of T1. In the illustrated example, the composition of the formation oil has changed, with the low viscosity fractions of the oil (at higher T1 values) being apparently flushed more effectively from the formation than the higher viscosity fractions. The higher viscosity portion of the formation oil remains in place and forms a relatively larger fraction of the residual oil which cannot be produced by water injection or flush alone.

Observing compositional changes such as described in the example above may provide important information to assist in decisions concerning the methods chosen at various stages in the life of the reservoir to recover its hydrocarbon content. They may also be used in determining the most efficient form of EOR treatment. If, for example, the recoverable oil left in the formation is more viscous than the produced oil, EOR treatments may be planned differently, taking into account the change in the viscosity of the remaining oil.

Apart from drawing conclusions on the efficacy of types of EOR treatments, it may also be possible to measure the effects of such a treatment on a very small scale but within a very short time period. Repeating the injection measurements as described above with an EOR treatment fluid rather than water, it may be possible to monitor directly the changes in the formation, in particular the residual oil saturation, with and without the EOR treatment tested. When testing a chemical based method, the relevant chemical components may be mixed to the internal fluid flow inside the tool. If a heat treatment is contemplated for testing, the injected fluid can be heated inside the tool body prior to injection into the formation. Thus, the embodiments within the scope of the present disclosure may provide a very fast screening method for a wide variety of existing and future EOR treatments which might otherwise take months or even years to test.

Figure 6:
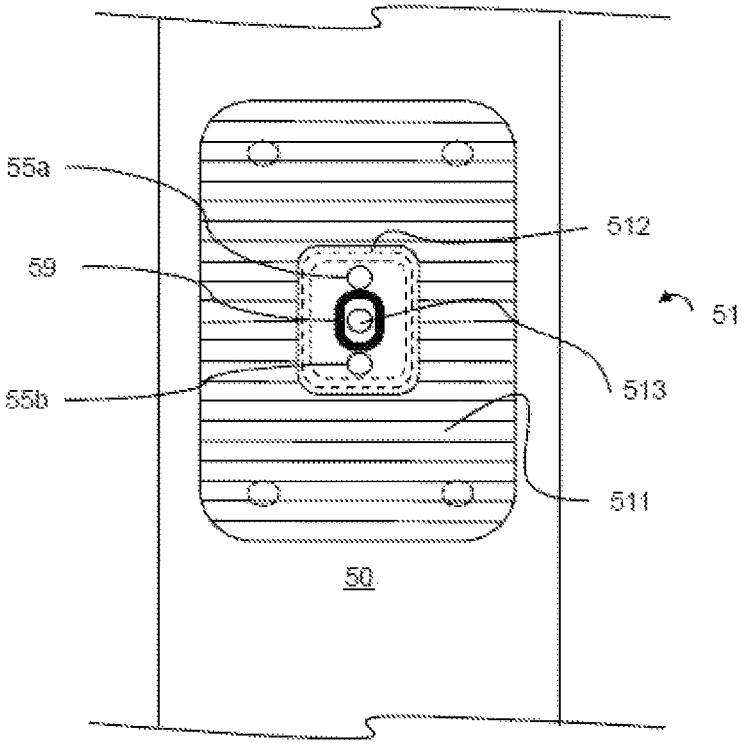
FIG. 6 is a schematic frontal view of apparatus according to one or more aspects of the present disclosure.

A further variant of a tool according to the present disclosure is illustrated in FIG. 6, showing a frontal of the schematics of a combined sampling tool having sample and guard inlets and an NMR tool.

A body 50 of the downhole logging tool includes a guard probe integral to a pad 51. The pad 51 includes an outer zone 511 of magnetic material behind a sealing layer of elastic material. The magnetic material of this example is permanently magnetic and can hence generate a magnetic field in those parts of the formation which face the probe. A recessed zone of the pad 51 includes flowlines 513, 55*a* and 55*b*. The flowline 513 may be fluidly coupled to a first pump (not shown) in the body 50 of the downhole logging tool. The flowlines 55*a* and 55*b* may be fluidly coupled to a second pump (not shown) in the body 50 of the downhole logging tool. Alternatively, the flowlines 513, 55*a* and 55*b* may be commingled into a single flow line in the body 50 of the downhole logging tool and coupled to a single pump. When the pad 51 makes contact with the formation, an inner packer 59 seals the flow line 513 from the flowlines 55*a* and 55*b*.

The inner packer 59 also defines a guard funnel between the inner packer 59 and the sealing layer of elastic material of the outer zone 511, fluidly coupled to the flowlines 55*a* and 55*b*. The inner packer 59 further defines a sample funnel surrounded by the inner packer 59 fluidly coupled to the flow line 513.

The inner zone of the pad 51 further includes an antenna area 512 configured to deliver NMR into the formation. While depicted as being recessed in the guard funnel, antenna area 512 may alternatively or additionally be located recessed in the sample funnel. The combination of an NMR tool and formation testing tool as shown above can be replaced by a combination of most of the known sensing fields whether acoustic, sonic or electromagnetic and formation testing tool.

Figure 7:
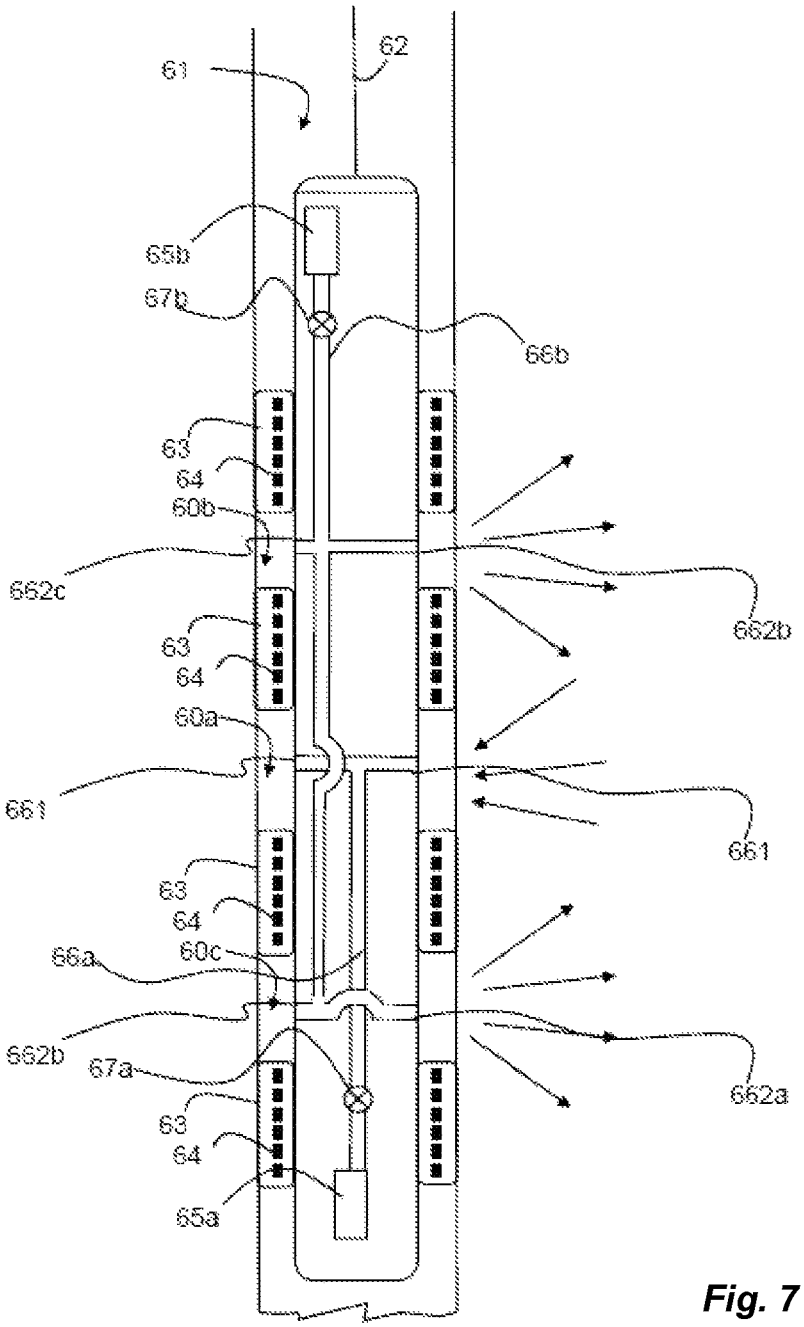
FIG. 7 is a schematic cross-sectional view of apparatus according to one or more aspects of the present disclosure.

A wireline suspended dual packer tool 61 suitable for performing measurements in accordance with another example of the disclosure is shown in FIG. 7. The tool 61 of FIG. 7 is configured to be suspended from a wireline 62 into an open hole. It has quadruple packers 63 with integrated arrays of sensors 64. The sensors 64 may be designed as an array of electrodes, antennas, gamma-ray receivers, or emitters, among others, depending on the measurement to be performed. The packers 63 are configured to isolate a sample zone 60*a* of the well.

The tool 61 further comprises a fluid reservoir chamber 65*a* connected to fluid ports 661 via a flow line 66*a*. The flow through the flow line 66*a* is driven by a pumping module 67*a*. The packers 63 also isolate guard zones 60*b* and 60*c* of the well.

The tool 61 further comprises a fluid reservoir chamber 65*b* connected to fluid ports 662*b* and 662*c* via a flow line 66*b*. The flow through the flow line 66*b* is driven by a pumping module 67*b*. The pumping module 67*a* and 65*b* may be configured to support flow from the formation into the reservoir chamber or from the chamber into the formation. Depending on the type of experiment to be performed, the chamber may contain sample fluids such as water or oil, or solutions of active chemicals to modify the formation, the formation fluids, or the response of the formation or formation fluid to the sensing field.

The configurations shown in FIGS. 6 and 7 may offer the advantage of the capability of the testing tool to separate the fluid entering the guard zones from the fluid entering the sample zone. However, such designs may be used for pumping filtrate flowing in the invaded zone of the formation with the intent of limiting the filtrate invasion into the measuring volume when a measurement is performed using the sensors 512 or 64. This may lead to measurements that are substantially more immune to formation contamination by mud filtrate.

The configurations shown in FIGS. 6 and 7 may also or alternatively offer the advantage of the capability of injection of a fluid in the guard zone while also sampling fluid in the sample zone, either simultaneously or with some delay, as illustrated in particular in FIG. 7. This operation may facilitate the flow of the injected fluid in the measuring volume of the sensors 512 or 64. It may also be possible to selectively inject a fluid into the sample zone while sampling fluid in the guard zone using the configurations shown in FIGS. 6 and 7. This operation may also facilitate the flow of the injected fluid in the measuring volume of the sensors 512 or 64. One or both of the simultaneous injection techniques may be used, depending on the desired effect, the formation being tested, and the shape of the measuring volume of the sensors 512 or 64. The flow rates in the sample zone and the guard zone may independently be adjusted or manipulated by varying the rate of pumps 67*a* and/or 67*b* to, for example, insure a desired injection zone in the formation. The flow rates in the guard and sample zone may be manipulated based on real time measurements provided by the sensors 512 or 64. In other words, the sensors 512 or 64 may be used to monitor the progress of the injection front, and their measurements may be used in a feedback loop to control the rates and the flow directions in the guard and sample zone.

Figure 8:
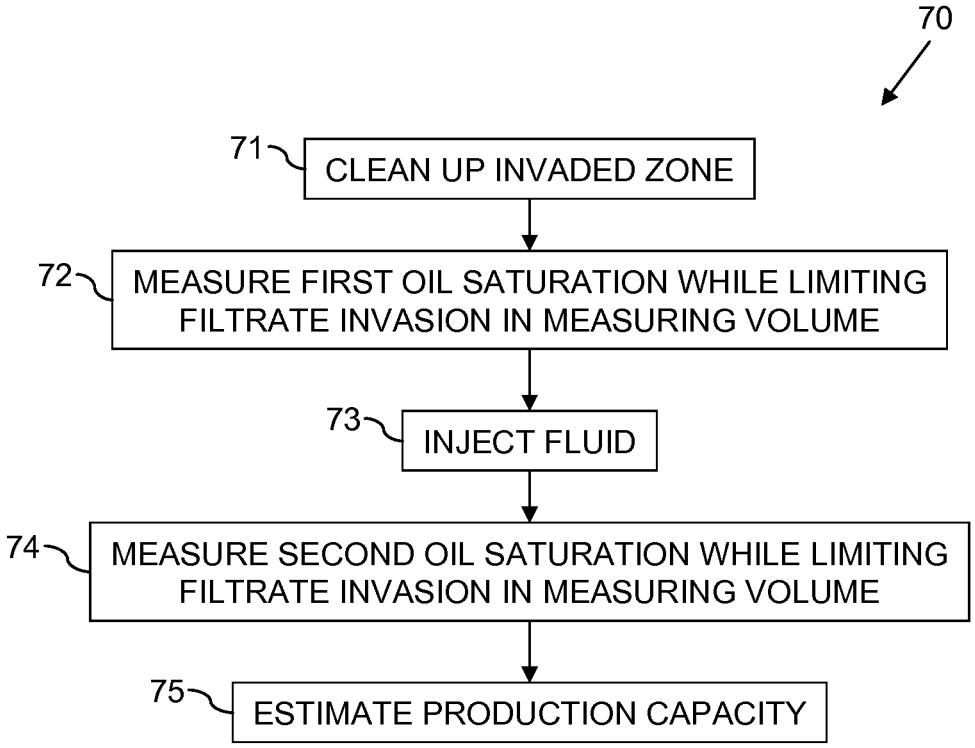
FIG. 8 is a flow-chart diagram of a method according to one or more aspects of the present disclosure.

FIG. 8 is a flow-chart diagram depicting a method 70 for estimating booking reserve according to one or more aspects of the present disclosure. The method 70 may be performed, for example, using the apparatus described herein or otherwise within the scope of the present disclosure.

At step 71, a fluid communication between the formation and a testing tool lowered in the well is established by extending a probe or a plurality of packers into sealing engagement with the formation. Formation fluid is pumped into the formation tester. In an initial phase, mud filtrate having seeped into the formation is extracted, but the invaded zone in front of the probe or the packers gradually cleans up as the extracted filtrate is replaced by pristine formation fluid. The cleanup process may be monitored by sensors disposed in a flow line of the downhole tool, using conventional or future-developed methods and/or apparatus.

At step 72, a first oil saturation is measured using an NMR sensor and/or other sensors described herein. As mentioned before, a more useful measure may be provided when filtrate invasion in the measuring volume is limited. A method discussed herein involves maintaining the seal between the testing tool and the formation after the cleanup of the invaded zone, and more particularly maintaining the pressure in the sealed portion essentially at or below the formation pressure. In addition, a guarded system similar to those shown in FIGS. 6 and 7 may be used to continuously pump the filtrate migrating in the formation during the measurement phase.

At step 73, a reservoir fluid is injected. In particular, water may be injected to stimulate residual oil saturation under water drive or water flood conditions, or natural gas may be injected to stimulate residual oil saturation under gas cap expansion drive or gas injection. To ensure as representative a process as possible, and to minimize potential safety issues related to the handling of live fluids at the surface, formation fluids collected into sample chambers at appropriate depths in the reservoir prior to performing the injection tests may advantageously be used as injection fluids.

At step 74, a second oil saturation is measured using an NMR sensor and/or other sensors described herein. For example, the second oil saturation may be measured when the sensor response remains essentially stationary, such as to insure that a residual oil saturation is measured. Alternatively, asymptotic values corresponding to large injection times may be extrapolated and the extrapolation used as the second oil saturation. As mentioned above, a more useful measure may be provided when filtrate invasion in the measuring volume is limited. A method of the present disclosure may thus involve maintaining the seal between the testing tool and the formation after the injection, and more particularly maintaining the pressure in the sealed portion essentially at or between the formation pressure and the wellbore pressure. In addition, a guarded system similar to those shown in FIGS. 6 and 7 may be used to continuously maintain a flow regime in the measurement volume that is beneficial to the measurement quality.

At step 75, a production capacity or booking reserve may be estimated using the first and second oil saturations. For estimating a total production capacity of a reservoir (e.g., a carbonate reservoir), the operation of steps 71 through 74 may be repeated several times along the well and in different wells. In transition zones (oil/water/gas), a plurality of measurements may be performed along the transition zone to obtain a realistic total production capacity (booking reserves).

Figure 9:
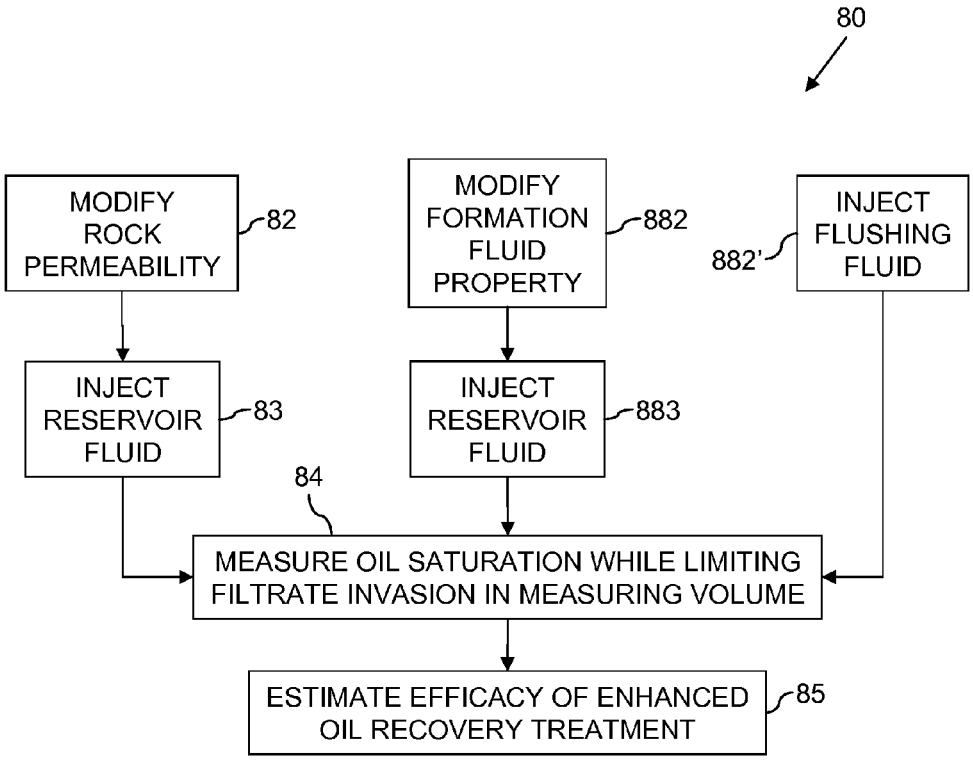
FIG. 9 is a flow-chart diagram of a method according to one or more aspects of the present disclosure.

FIG. 9 is a flow-chart diagram of a method 80 for estimating efficacy of enhanced oil recovery treatments according to one or more aspects of the present disclosure. The method 80 may be performed, for example, using the apparatus described herein. Further, while the steps of the method 80 have been described separately for ease of understanding, in actual practice, such steps may be combined and/or rearranged or omitted, as desired. Still further, the method 80 may be used in combination with method 70. Indeed, the method 70 may be used to determine a production capacity without enhanced oil recovery treatment. This production capacity may be compared with the results obtained with the method 80. In particular, the method 80 may optionally, but not necessarily, be performed at the same testing location(s) as used for the method 70.

Referring to FIG. 9, a fluid communication between the formation and a testing tool lowered in the well has been established by extending a probe or a plurality of packers into sealing engagement with the formation. At step 82, the rock permeability is modified using the testing tool. The objective may be to create or enhance micro-fractures in the formation, or to plug micro-fractures existing in the formation.

In some cases, the formation is fractured by pumping a fluid, e.g., wellbore fluid, into the sealed interval at a sufficient rate. One or more proppant materials may be added to the injection fluid to maintain the fractures in an opened position when injection is ceased. Polymers and thixotropic or viscoelastic materials may be added to the injection fluid to increase its viscosity and facilitate fracturing. In other cases, acid is injected into the formation for dissolving a portion of the rock. The acid may be conveyed downhole in a fluid reservoir chamber, or may be generated in situ by mixing water or other fluid with salts conveyed in a reservoir chamber of the downhole tool, or by an electrochemical reaction performed by the testing tool. Caustic solutions may also or alternatively be injected in some formations. In other cases, one or more resins, colloidal sands, and/or other permeability blocking agents may be injected to reduce the permeability of micro-fractures in the formation that bypass oil bearing zone in the formation located therebetween.

At step 83, a reservoir fluid is injected into the formation. Then, at step 84, an oil saturation is measured, for example as described in steps 73 and 74 of FIG. 8. At step 85, efficacy of the enhanced recovery treatment performed at step 82 is estimated, for example by comparing the oil saturation measured at step 84 with an oil saturation measured at step 74 of FIG. 8. When the reduction of oil saturation extrapolated at the scale of the reservoir overcomes the cost of a production scheme that reproduces the treatment performed at step 82, the production scheme that reproduces the treatment performed at step 82 may be adopted.

Still referring to FIG. 9, at step 882, a property of the formation fluid in the formation may be modified. The objective may be to reduce its viscosity, or to modify its capillary pressure of the formation water or the formation oil (and, thereby, the rock wettability).

In a first example using local injection techniques, once a fluid communication between a testing tool lowered in the well and the formation has been established by extending a probe or a plurality of packers into sealing engagement with the formation, one or more solvents (e.g., soluble gas such as nitrogen or carbon dioxide, among other) and/or other viscosity modifiers, hot fluids (e.g., hot solvents), and/or steam may be injected into the formation to reduce the viscosity of the oil at step 882. In other examples, surfactants such as emulsifiers, dispersants, oil-wetters, water-wetters, foamers and/or defoamers are injected to modify the rock wettability and thereby the relative permeability curves shown in FIGS. 5A and 5B.

Electromagnetic and/or microwave heat may also or alternatively be applied to the formation at step 882. In such embodiments, a step 883 involving the injection of a reservoir fluid (e.g., gas or water) may also be performed. However, the step is 883 optional, as the oil in the formation may have been displaced by the fluid injected at step 882. The method 80 may further comprise a measurement step and an interpretation step, similar to the steps 84 and 85 described previously.

A flushing fluid other than the reservoir fluid may be injected at step 882', in lieu of step 882. The objective may to replace the reservoir fluid with a fluid having a higher sweep efficiency. For example, a mixture of reservoir fluid containing polymer additives to increase its viscosity, or a micellar solution may be injected. Alternatively, flue gases, hydrocarbons or carbon dioxide may be injected. In some cases, a plurality of different fluids may successively be injected, such as an alternating succession of water and gas.

One embodiment of the method 80 shown in FIG. 9 may comprise steps 82, 83, 84, and 85, but not steps 882, 883, and 882'. Another embodiment of the method 80 shown in FIG. 9 may comprise steps 882, 883, 84, and 85, but not steps 82, 83, and 882'. Another embodiment of the method 80 shown in FIG. 9 may comprise steps 882', 84, and 85, but not steps 82, 83, 882, and 883. Other embodiments of the method 80 within the scope of the present disclosure may comprise other combinations of the steps shown in FIG. 9, including in sequences other than as depicted in FIG. 9.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A tool for evaluating an enhanced oil recovery treatment applied to a subterranean formation, comprising:

a sensing device configured to generate a sensing field within a measuring volume of the formation;

a flow generating device configured to cause a flow through the measuring volume;

means for applying the enhanced oil recovery treatment to a sealed portion of the subterranean formation;

an array of sensors responsive to changes in the sensing field, wherein responses of the array of sensors are indicative of an amount of constituent fluid phases in the measuring volume; and a first pair of packers configured to isolate a zone of the subterranean formation, wherein the array of sensors is integrated into the pair of packers.

2. The tool of claim 1 wherein the enhanced oil recovery treatment applying means comprise a pump configured to inject a flushing fluid having a higher sweep efficiency than a formation fluid residing in the subterranean formation proximate the tool.

3. The tool of claim 2 wherein the flushing fluid comprises at least one agent selected from the group consisting of a micellar solution, a mixture of reservoir fluid with polymer additives, flue gases, and carbon dioxide.

4. The tool of claim 2 wherein the pump is configured to alternate injection of at least two of a hydrocarbon, a gas and water.

5. The tool of claim 1 further comprising a sealing pad extendible from a main body and configured to establish a sealing contact with the formation, wherein the sealing pad comprises a guard inlet and a sample inlet.

6. The tool of claim 1 further comprising a plurality of packers extendible from a main body and configured to establish a sealing contact with the formation, wherein the plurality of packers are configured seal a guard zone and a sample zone in the extended position.

7. The tool of claim 1 comprising a second pair of packers, wherein the array of sensors is integrated into the second pair of packers.

8. The tool of claim 1, wherein the array of sensors comprises electrodes, antennas, gamma-ray receivers, or emitters.

9. A method of evaluating efficacy of an enhanced oil recovery treatment applied to a subterranean formation, comprising:

providing a tool in a section of a well penetrating the formation, wherein the tool comprises:

a sensing device configured to generate a sensing field within a measuring volume of the formation;

a flow generating device configured to cause a flow through the measuring volume;

an array of sensors responsive to changes in the sensing field; and a first pair of packers configured to isolate a zone of the subterranean formation, wherein the array of sensors is integrated into the pair of packers;

applying the enhanced oil recovery treatment to a sealed portion of the subterranean formation; and measuring responses of the array of sensors indicative of an amount of constituent fluid phases in the measuring volume.

10. The method of claim 9 wherein applying the enhanced oil recovery treatment comprises modifying a rock permeability, and wherein modifying the rock permeability comprises injecting at least one of an acid, a fracturing fluid, and a permeability blocking agent.

11. The method of claim 9 wherein applying the enhanced oil recovery treatment comprises modifying a formation hydrocarbon property, and wherein modifying the formation hydrocarbon property comprises injecting at least one of a solvent, a viscosity modifier, a hot fluid, and steam.

12. The method of claim 9 wherein applying the enhanced oil recovery treatment comprises modifying a formation hydrocarbon property, and wherein modifying the formation hydrocarbon property comprises injecting at least one of an emulsifier, a dispersant, an oil-wetter, a water-wetter, a foamer, and a defoamer.

13. The method of claim 9 wherein applying the enhanced oil recovery treatment comprises injecting a flushing fluid having a higher sweep efficiency than a formation fluid residing in the subterranean formation proximate the tool.

14. The method of claim 13 wherein the flushing fluid comprises at least one agent selected from the group consisting of a micellar solution, a mixture of reservoir fluid with polymer additives, flue gases, and carbon dioxide.

15. The method of claim 9 further comprising extending a sealing pad from a main body to establish a sealing contact with the formation, wherein the sealing pad comprises a guard inlet and a sample inlet.

16. The method of claim 9 further comprising extending a plurality of packers from a main body to establish a sealing contact with the formation, wherein the plurality of packers seal a guard zone and a sample zone in the extended position.

17. The method of claim 9 wherein the tool comprises a second pair of packers, wherein the array of sensors is integrated into the second pair of packers.

18. The method of claim 9, wherein the array of sensors comprises electrodes, antennas, gamma-ray receivers, or emitters.

* * * * *